US012116741B2

(12) United States Patent
Pusat et al.

(10) Patent No.: US 12,116,741 B2
(45) Date of Patent: Oct. 15, 2024

(54) CRUISE PORT OPERATION SYSTEM AND METHOD

(71) Applicant: Galataport Istanbul Liman Isletmeciligi Ve Yatirimlari Anonim Sirketi, Istanbul (TR)

(72) Inventors: Ali Pusat, Istanbul (TR); Figen Ayan, Istanbul (TR); Necil Adiyaman, Istanbul (TR)

( * ) Notice: Subject to any disclaimer, the term of this patent is extended or adjusted under 35 U.S.C. 154(b) by 27 days.

(21) Appl. No.: 17/263,486

(22) PCT Filed: Jun. 11, 2020

(86) PCT No.: PCT/TR2020/050503
§ 371 (c)(1),
(2) Date: Jan. 26, 2021

(87) PCT Pub. No.: WO2021/150180
PCT Pub. Date: Jul. 29, 2021

(65) Prior Publication Data
US 2022/0112675 A1 Apr. 14, 2022

(51) Int. Cl.
*E02B 3/06* (2006.01)
*E01D 15/24* (2006.01)
*E02B 3/20* (2006.01)

(52) U.S. Cl.
CPC ..... *E02B 3/20* (2013.01); *E01D 15/24* (2013.01); *E02B 3/068* (2013.01)

(58) Field of Classification Search
CPC . E02B 3/20; E02B 3/068; E01D 15/24; B63B 35/00; B63B 35/003; B63B 35/40; B63B 2035/004; B63C 1/00
See application file for complete search history.

(56) References Cited

U.S. PATENT DOCUMENTS 1,802,042 A * 4/1931 Barlow ..... E01D 15/24 14/69.5
3,724,015 A * 4/1973 Japes ..... B64F 1/305 104/71
4,335,803 A * 6/1982 Sugita ..... E01D 15/24 182/12
4,366,591 A * 1/1983 Zimmerman ..... B63B 27/14 182/2.11
4,788,643 A * 11/1988 Trippe ..... G06Q 10/02 705/6
4,837,989 A * 6/1989 Levy ..... E04H 14/00 52/27

(Continued)

OTHER PUBLICATIONS

Chakravarty; Luxury Launches; "Dror and Gensler propose world's first underground cruise operation for Istanbul's Galataport"; May 11, 2017; https://luxurylaunches.com/other_stuff/dror-and-gensler-propose-worlds-first-underground-cruise-operation-for-istanbuls-galataport.php (Year: 2017).*

(Continued)

*Primary Examiner* — Edwin J Toledo-Duran
(74) *Attorney, Agent, or Firm* — Egbert, McDaniel & Swartz, PLLC

(57) ABSTRACT

Disclosed is a transfer system and method that enables the use of the port area and the elimination of the negative effects of traffic in the city, by making the landing or boarding operations of cruise ships underground in the cruise ports.

2 Claims, 1 Drawing Sheet

(56) References Cited

U.S. PATENT DOCUMENTS 5,460,462 A * 10/1995 Regan ..... E06B 9/00 405/87
5,603,189 A * 2/1997 Levy ..... E04H 1/04 119/245
5,853,264 A * 12/1998 Treveloni ..... E02F 7/023 114/34
6,330,726 B1 * 12/2001 Hone ..... B64F 1/305 14/71.3
6,524,050 B1 * 2/2003 Arntzen ..... E02B 3/20 414/137.4
9,108,744 B2 * 8/2015 Takeuchi ..... B64F 1/305
2010/0183407 A1 * 7/2010 Kim ..... B65G 63/004 414/139.4
2012/0204361 A1 * 8/2012 Anderberg ..... E01D 15/24 14/71.1
2012/0204364 A1 * 8/2012 Anderberg ..... E01D 15/24 14/71.1
2013/0247310 A1 * 9/2013 Bonvila Bonet ..... B64F 1/3055 14/71.1
2013/0341144 A1 * 12/2013 Gluckhardt ..... E02B 3/20 191/12 R
2014/0348592 A1 * 11/2014 Salas Garcia ..... B63C 1/04 405/219
2016/0214688 A1 * 7/2016 Thelander ..... B63B 27/14
2019/0002217 A1 * 1/2019 Ramos ..... E01D 15/24
2019/0009927 A1 * 1/2019 Obinna ..... B64F 1/3055
2020/0156807 A1 * 5/2020 King ..... B64F 1/30
2021/0039547 A1 * 2/2021 Stubler ..... B65D 90/0066

OTHER PUBLICATIONS

Bond; Seatrade Cruise News; "As ships return to Istanbul, innovative Galataport terminal set for 2020 debut"; May 6, 2019; https://www.seatrade-cruise.com/news-headlines/ships-return-istanbul-innovative-galataport-terminal-set-2020-debut (Year: 2019).*

Thyssenkrupp; Apr. 30, 2019; https://www.tkelevator.com/global-en/newsroom/press-releases/thyssenkrupp-welcomes-cruise-ship-visitors-as-mobility-solutions-partner-at-istanbuls-new-galataport-harbour-92224.html (Year: 2019).*

Hinds; Alamy; "Suitcases being loaded onto a cruise ship by baggage handlers in Southampton, England"; Aug. 7, 2010; https://www.alamy.com/stock-photo-suitcases-being-loaded-onto-a-cruise-ship-by-baggage-handlers-in-southampton-30967016.html (Year: 2010).*

International Search Report and Written Opinion of the International Searching Authority for corresponding PCT/TR2020/050503, dated Oct. 21, 2020.

https://www.designboom.com/architecture/dror-gensler-galataport-masterplan-istanbul-turkey-05-04-2017/ (Cited in International Search Report).

https:luxurylaunches.com/other_stuff/dror-and-gensler-propose-worlds-first-underground-cruise-operation-for-istanbuls-galataport.php (Cited in International Search Report).

* cited by examiner

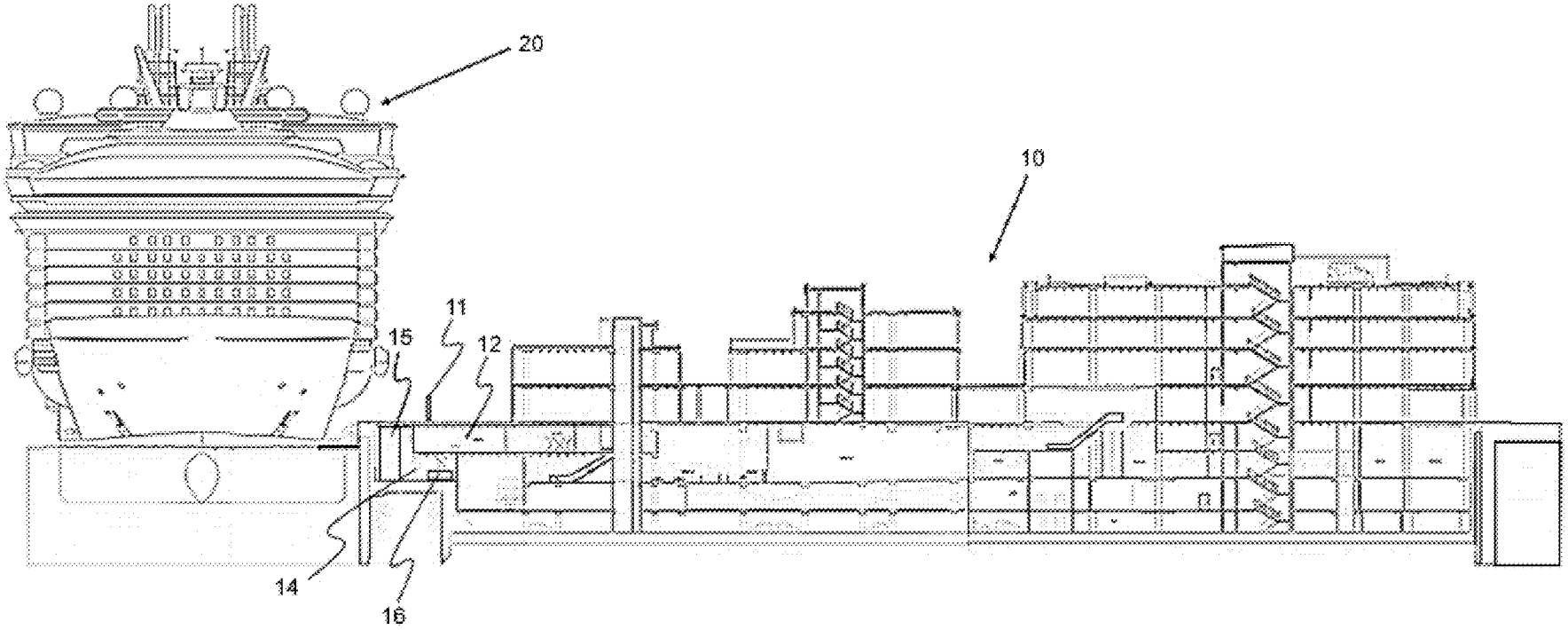
10
20
11
12
15
16
14

CRUISE PORT OPERATION SYSTEM AND METHOD

TECHNICAL FIELD

The invention relates to a cruise port operation system and method for the processes related to passengers, their belongings, stores and/or spare parts of the ship, a customs bonded zone or a customs-free zone.

The invention particularly relates to a transfer system and method that enables the efficient use of the port area and eliminates the negative effects of the traffic in the city by carrying out the transfer processes of the passengers, luggage, vehicles and cargoes, which are located underground in accordance with the customs legislation in the cruise ports.

STATE OF THE ART

The cruise industry is one of the most popular tourism activities around world. Cruise ship and port management are the two important components of cruise tourism. Cruise ports are the access and border gates for the cruise ships, which are carrying people with the help of preorganized tours and allow passengers to enter and exit the country.

Cruise ports and its perimeters are subject to customs regulations and legislations, and are giving services such as cargo, passenger handling, storage, cargo or passenger transfer etc. Entry to these areas is not permitted except the personnel/visitor who are authorized and/or permitted for access.

In most of the ports around the world, the ports are located far from the city centers and are connected via road and railway webs. Since the city borders have developed as a result of the increasing population and unplanned housing, the port facilities have remained within the city center and have started to influence the flow of daily life in the cities. In addition to these aspects which negatively affect the city traffic, the port structures which cause visual pollution are converted into passive facilities or they have to be moved to new locations and thus to be closed. In case the ports which remain within the city and continue to serve are revised and their current areas are revaluated, the port facility shall be structured such that it does not prevent the texture of the city and daily life.

As a result, in order to solve the problems above and the limitations of available solutions made it necessary to create a development in the relevant technical field.

PURPOSE OF THE INVENTION

The present invention is related to a cruise port operation system and method, which eliminates the disadvantages mentioned above and bring new advantages to the relevant technical field.

The main purpose of the system is to enable efficient use of the port area by carrying out the transfer processes of the passengers and cargo underground in accordance with the customs legislation in the cruise ports and eliminate the negative effects of the traffic in the city.

The purpose of the invention is to carry on the cruise activities while keeping the custom regulations and give access to the 1.2 km frontline. It will enable the port area to be put into service of the city by means of performing the operations such as cargo or passenger flow, storage, cargo and passenger transfer in underground.

Another purpose of the invention is to eliminate the requirement of assigning new areas for high capacity ports.

In order to achieve all of the aforementioned purposes and the ones that can be inferred from the detailed description; the invention is a cruise port operation system for the processes related with passengers travelling with the cruise ships, their goods and store and/or spare parts of cruise ship within the customs bonded zone or the customs-free zone. The system comprises the following,

- pier consisting a mechanical opening and closing barrier system, namely "hatches" to make the berthing area become a temporary customs bonded zone,
- terminal area formed in the underground where the processes of passport control, luggage operations, customs operations, shopping, operations regarding tour buses and taxis are managed by directing the passengers which are getting off or on the cruise ships,
- operational underground tunnel for handling cargo and luggage,
- vertical heavy load platforms/lifts which is located within the operation tunnel and enables transportation of the cargo and luggage coming from the cruise ships to the operation tunnel or transportation of the cargo and luggage in the operation tunnel to the cruise ships,
- Underground conveyor belt system which enables to carry luggages between ship to separate terminals under security control.

The invention is a cruise port operation method for the processes related with the passengers travelling with the cruise ships, their goods and the store and/or spare parts of cruise ship within the customs bonded zone or customs-free zone. The method comprises the following process steps, a) Making the berthing area as a temporary customs bonded zone by means of opening the hatches before the cruise ship's berth to the cruise port,
b) Directing the passengers getting off the cruise ship, from the temporary customs bonded zone formed by the hatches in the pier, to the terminal area formed underground or directing the passengers getting on the cruise ship from the terminal area formed underground to the pier which is a temporary customs bonded zone formed by the hatches,
c) Carrying out the processes of passport control, luggage operations, customs operations, shopping, tour buses and operations regarding getting in and out of buses or taxis in the terminal area formed in the underground,
d) Transporting the cargo and luggage coming from the cruise ships to the operation tunnel or transporting the cargo and luggage in the operation tunnel to the cruise ships by means of the vertical heavy load platforms/lifts,
e) Carrying the luggage in the operation tunnel to the separate luggage areas in the terminal area or to the operation tunnel from the luggage drop off points in the terminal area by means of the conveyor belts so as to be picked up by the passengers.

The structural and characteristic features of the present invention will be understood clearly by the following drawings and the detailed description made with reference to these drawings. Therefore, the evaluation shall be made by taking these figures and the detailed description into consideration.

BRIEF DESCRIPTION OF THE DRAWING

FIG. 1 is a diagrammatic illustration of the system of the present invention.

DESCRIPTION OF THE PART REFERENCES

10. Cruise port
11. Hatches
12. Terminal area
14. Operation tunnel
15. Heavy load platforms/lifts
16. Conveyor Belt
20. Cruise ship

DETAILED DESCRIPTION OF THE INVENTION

In this detailed description, the preferred alternatives of the inventive cruise port operation system and method have been described in a manner not forming any restrictive effect and only for purpose of better understanding of the matter.

The invention is a cruise port operation system for the processes related with the passengers travelling with the cruise ships (20), their goods and store and/or spare parts of cruise ship (20) within the a customs bonded zone or a customs-free zone. The system comprises the following

- hatches (11) consisting of a mechanical opening and closing barrier to make the pier become a temporary customs bonded zone,
- a terminal area (12) formed in the underground and where the processes of passport control, luggage operations, customs operations, shopping, operations regarding getting in and out of tour buses and taxi are carried out by directing the passengers that get off the cruise ships (20) or get on the cruise ships (20),
- an operation tunnel (14) formed in the underground and where cargo and luggage that come to the cruise ships (20) and that leave the cruise ships (20) are handled,
- a vertical heavy load platforms/lifts (15) which is located within the operation tunnel (14) and enables transportation of the cargo and luggage coming from the cruise ships (20) to the operation tunnel (14) or transportation of the cargo and luggage in the operation tunnel (14) to the cruise ships (20),
- a conveyor belt (16) which enables to carry the luggage discharged to the operation tunnel (14) to different luggage storage terminals or enables intermediate transfer of the luggage brought with the passenger to be laden for passing the same from the safety control.

The illustrative view of the system is given in FIG. 1. Accordingly; there are hatches (11) on the pier so as to provide transfer for the passenger who gets off or gets in the cruise ships (20) and the cargo which is loaded to or unloaded from the same in the cruise port (10). The hatches (11) are a mechanically openable and closable barrier that enables the berthing area to become a temporary customs bonded zone.

Bidirectional terminal area (12) is formed under the ground of the dock area on which the passengers that get off the cruise ships (20) or get on the cruise ships (20) walk. The terminal area (12) is a customs bonded zone where the passport control, luggage operations, customs operations, shopping, operations regarding getting in and out of tour buses and taxis are carried out by directing the passengers that get off the cruise ships (20) or get on the cruise ships (20) in the temporary customs bonded zone formed by the hatches (11). The processes of the passengers that get off the cruise ships (20) or get on the cruise ships (20) are carried out in different halls which are in the opposite direction to each other within the terminal area (12) thanks to the bidirectional feature of the terminal area (12).

The operation tunnel (14) which is formed in underground can handle cargo and luggage that come to the cruise ships (20) and leave the cruise ships (20)

There are vertical heavy load platforms or lifts (15) within the operation tunnel (14) which enables transportation of the cargo and luggage coming from the cruise ships (20) to the operation tunnel (14) or transportation of the cargo and luggage in the operation tunnel (14) to the cruise ships (20). Also, there is a conveyor belt (16) which enables to transfer the luggages in the operation tunnel (14) to the luggage areas in the terminal area (12) to be picked up by the passengers or to transport the same from the luggage drop off points where the luggage is left to the safety points in the operation tunnel (14).

The invention is a cruise port operation method for the processes related with the passengers travelling with the cruise ships (20), their goods and store and/or spare parts of the cruise ship (20) within the a customs bonded zone or a customs-free zone. The method comprises the following process steps;

a) Making the berthing area as a temporary customs bonded zone by means of opening the hatches (11) before the cruise ships (20) arrival to the cruise port (10),
b) Directing the passengers getting off the cruise ship (20) from the temporary bonded zone formed by the hatches (11) in the berthing area to the terminal area (12) formed under ground or directing the passengers getting on the cruise ship (20) from the terminal area (12) formed underground to the temporary customs bonded zone formed by the hatches (11),
c) Carrying out passport control, luggage operations, customs operations, shopping, operations regarding getting in and out of tour buses and taxis in the terminal area (12) formed in the underground,
d) Transporting the cargo and luggage coming from the cruise ships (20) to the operation tunnel (14) or transporting the cargo and luggage in the operation tunnel (14) to the cruise ships (20) by means of the vertical heavy load platforms/lifts (15),
e) Carrying the luggage in the operation tunnel (14) to the luggage areas in the terminal area (12) or to the operation tunnel (14) from the luggage areas in the terminal area (12) by means of the conveyor (16) so as to be picked up by the passengers.

The invention claimed is:

1. A cruise port operation system for processing of passengers traveling on a cruise ship and for goods of the passengers and for spare parts of the cruise ship within a customs bonded zone or a customs-free zone, the cruise port operation system comprising:

a plurality of hatches each comprising a mechanical opening and closing barrier system adapted to make a berthing area into a temporary customs bonded zone, wherein said plurality of hatches are located on a pier, said plurality of hatches adapted to provide for transfer for a passenger that exits or enters the cruise ship and for a cargo loaded or unloaded from the cruise sip in a cruise port;

a terminal area formed underground of said plurality of hatches, the terminal area being where passport control and luggage processing and customs operations and shopping and tour bus and taxi operations are carried out by directing passengers to or from the cruise ship, the passengers accessing said terminal area via said plurality of hatches, wherein the passport control and luggage processing and customs operations and shipping and tour bus and taxi operations are carried out in different halls that are in opposite directions to each other within said terminal area;

an operations tunnel formed underground, said operation tunnel adapted to allow handling of cargo and luggage from and to the cruise ship therein;

a vertical load platform or lift positioned between said plurality of hatches and said operations tunnel and adapted to allow transportation of the cargo and luggage from the cruise ship to said operations tunnel or to allow transportation of the cargo and luggage in said operations tunnel to the cruise ship; and a conveyor or belt adapted to carry the luggage discharged in said operations tunnel to a luggage storage terminal or to enable an intermediate transfer of the luggage of the passengers to be laden for passing from a safety control.

2. A cruise port operation method for use within a customs bonded zone or a customs-free zone, the cruise port operation method comprising:

making a berthing area into a temporary customs bonded zone by opening a plurality of hatches prior to arrival of a cruise ship to a cruise port;

forming an operations tunnel underground of the plurality of hatches;

directing passengers from the cruise ship from the temporary customs bonded zone to a terminal area, the terminal area being formed underground or directing passengers boarding the cruise ship from a terminal area formed underground to the temporary customs bonded zone, the terminal area being accessed by the passengers via the plurality of hatches;

carrying out passport control and luggage processing and customs operations and shopping and tour bus and taxi operations in the terminal area;

transporting cargo and luggage from the cruise ship to an operations tunnel or transporting the cargo and luggage in the operations tunnel to the cruise ship by a vertical load platform or lift, the vertical load platform or lift positioned between the plurality of hatches and the operations tunnel; and carrying the luggage in the operations tunnel to a luggage area in the terminal area or to the operations tunnel from the luggage area by a conveyor belt such that the passengers can pick up the luggage.

* * * * *